US006441813B1

(12) United States Patent
Ishibashi

(10) Patent No.: US 6,441,813 B1
(45) Date of Patent: Aug. 27, 2002

(54) COMPUTER SYSTEM, AND VIDEO DECODER USED IN THE SYSTEM

(75) Inventor: Yasuhiro Ishibashi, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/076,726

(22) Filed: May 13, 1998

(30) Foreign Application Priority Data

May 16, 1997 (JP) ..... 9-127398
May 16, 1997 (JP) ..... 9-127399

(51) Int. Cl.[7] ..... G09G 5/00
(52) U.S. Cl. ..... 345/213; 348/441
(58) Field of Search ..... 345/302; 348/441, 348/448, 459, 446, 558

(56) References Cited

U.S. PATENT DOCUMENTS

| | | | | |
|---|---|---|---|---|
| 5,373,323 A | | 12/1994 | Kwon | |
| 5,457,499 A | * | 10/1995 | Lim | 348/474 |
| 5,508,750 A | * | 4/1996 | Hewlett et al. | 348/558 |
| 5,510,840 A | | 4/1996 | Yonemitsu et al. | |
| 5,563,660 A | | 10/1996 | Tsukagoshi | |
| 5,594,552 A | * | 1/1997 | Fujinami et al. | 386/131 |
| 5,703,654 A | * | 12/1997 | Iizuka | 348/446 |
| 5,798,788 A | * | 8/1998 | Meehan et al. | 348/180 |
| 5,812,202 A | * | 9/1998 | Ng et al. | 348/446 |
| 6,118,491 A | * | 9/2000 | Wu et al. | 348/526 |

FOREIGN PATENT DOCUMENTS

| | | |
|---|---|---|
| JP | 6-197273 | 7/1994 |
| JP | 7-99603 | 4/1995 |
| JP | 7-298212 | 11/1995 |
| JP | 8-265639 | 10/1996 |
| JP | 8-265709 | 10/1996 |
| JP | 9-55879 | 2/1997 |
| JP | 9-74564 | 3/1997 |

* cited by examiner

*Primary Examiner*—Richard Hjerpe
*Assistant Examiner*—Alexander Eisen
(74) *Attorney, Agent, or Firm*—Finnegan, Henderson, Farabow, Garrett & Dunner, L.L.P.

(57) ABSTRACT

A VGA controller has a simple field synthesis mode and an interpolation mode, both for interlace/noninterlace conversion. The switching between these two modes is dynamically controlled in accordance with the value of a progressive flag signal output from a DVD decoder 112. If the value of the progressive flag is "1", this means that frame data is being decoded, so that the simple field synthesis mode is used. On the other hand, if the value of the progressive flag is "0", this means that the decoding of field data has been started, so that the conversion mode is switched to the interpolation mode. In the interpolation mode, fields are not synthesized together, and a line which is absent in each field is interpolated so as to produce frames for noninterlace display. The mask circuit of the DVD decoder receives a repeat first field flag register (Rep-Reg), each time signal Vsync is output. If the repeat first field flag is "1", signals Vsync and Hsync corresponding to the next field are masked. The signals are automatically released from the masked state when signal Vsync is output next. During the period in which signals Vsync and Hsync are masked, the VGA controller does not capture video data. Accordingly, repeat fields can be easily excluded from the field synthesis processing.

6 Claims, 10 Drawing Sheets

COMPUTER SYSTEM, AND VIDEO DECODER USED IN THE SYSTEM

BACKGROUND OF THE INVENTION

This application is based on Japanese Patent Application No. 9-127398, filed on May 16, 1997, and Japanese Patent Application No. 9-127399, filed on May 16, 1998, the content of which are cited herein by reference.

The present invention relates to a computer system and a video decoder, and more particularly to a computer system having a function of decoding digital compressed codes of motion-picture data and displaying the motion-picture data on a display monitor of a noninterlace display system, and a video decoder used in the system.

With the recent development in the field of computers and multimedia technology, more and more computers capable of executing multimedia applications are developed. The computers of this type have a function of reproducing not only text and graphics data but also motion pictures and sound data.

In accordance with an increase in the number of multimedia computers, DVDs are attracting the attention of those skilled in the art, as a new type of storage media replacing CD-ROMs. About 4.7 GB of data, which is about seven times greater in amount than the data recorded on a traditional CD-ROM, can be recorded on one side of a DVD-ROM, and about 9.4 GB of data can be recorded on two sides of the DVD-ROM. The use of the DVD-ROM enables movie titles, which contain a large amount of video information, to be reproduced on a computer screen with high quality.

Video information stored on a DVD-ROM is made up of two kinds of data: presentation data and navigation data. The presentation data is data on video objects to be reproduced, and includes video, sub-picture and audio data. The video data is 1 and compressed according to MPEG-2, while the sub-picture and the audio data are compressed according to run-length encoding or Dolby digital system. The sub-picture data is bit-map data, and used to represent movie titles or display a number of choice items on a menu screen. One video object can include video data of one channel, audio data of up to 8 channels, and sub-picture data of up to 32 channels.

The navigation data is reproduction control data used for controlling the order in which presentation data are reproduced, and navigation commands can be embedded in the navigation data. The navigation commands are used for changing the contents of video data to be reproduced and the order in which they are reproduced. By using the navigation commands, the person who prepares the movie titles can define various tree structures in them, so as to make the movie titles interactive.

The titles are prepared on the assumption that they will be reproduced on a home TV by use of a commercially-available player. The contents of the titles are the following two:

(1) frame data (progressive data) which is encoded at a frame rate of 24 Hz, like a movie film; and (2) field data which is encoded at a rate of 60 Hz (i.e., the number of field data pieces used per second is 60).

Some of the titles are a combination of data (1) and (2) above. For example, a program is constituted by data (1), namely, frame data (progressive data), while CM information is constituted by field data.

Both the frame data (progressive data) and the field data (data [1] and data [2]) are decoded by a DVD decoder. This DVD decoder outputs 60 Hz field data for interlace display corresponding to an NTSC output. In order to display the field data on the display monitor of a computer, the data for interlace display output from the DVD decoder has to be converted into data for noninterlace display. This conversion is executed by use of simple field synthesis. That is, an even-numbered field and an odd-numbered field are synthesized in a frame memory to produce one frame, and this frame is shown on the display monitor of a computer in a noninterlace fashion.

According to the interlace/noninterlace conversion based on the single field synthesis, fields between which a time difference exists are synthesized into one frame. This results in a so-called "feathering" phenomenon, wherein the outline of the frame appears to. have a fringe. This phenomenon is marked particularly in the case of a quick motion scene.

The "feathering" phenomenon is attributable to the following two causes:

(i) Field Picture Problem

This problem is due to the synthesis of field data (data [2]). Since each field picture corresponds to a time difference of 1/60 seconds, synthesis of them inevitably produces "feathering".

(ii) Repeat Field Problem:

When a DVD decoder decodes frame data (progressive data) of 24 frames/sec, it uses a method called "3:2 pulldown". By this method, frame data of 24 frames/sec is converted into field data of 60 fields/sec. The "3:2 pulldown" method is shown in FIG. 11.

Referring to FIG. 11, "Frame No." indicates the frame number of frame data (24 frames/sec) which is not yet decoded. "Field No." indicates the field number of field data (60 fields/sec) which is already decoded and corresponds to NTSC. The suffix letter "E" of the field number indicates that the field is even-numbered, while the suffix letter "O" indicates that the field is odd-numbered.

In the "3:2 pulldown" method, the difference in frame rate is dealt with by preparing three fields from one frame, and two of three frames are used in the processing for preparing three fields. When three fields are prepared, the third field is the same data as the first field (R: a repeat field). In FIG. 11, the third field of the first frame is a repetition of the first field (1E), and the third field of the third frame is also a repetition of the first field (3O).

In the simple field synthesis processing, consecutive two field pictures (namely, 1E and 1O, 1E and 2O, 2E and 3O, . . . ) are synthesized together, as shown in FIG. 11. What becomes a problem at the time of synthesis is the combination between fields 1E and 2O and the combination between fields 2E and 3O. Fields 1E and 2O are prepared from data of different frame numbers, and there is a time difference of 1/24 seconds between fields 1E and 2O. Likewise, there is a time difference of 1/24 seconds between fields 2E and 3O. As can be seen from this, a frame produced by a combination of fields that includes a repeat field causes "feathering."

As described above, if titles prepared for a TV are displayed on a display monitor of noninterlace display system, the field picture problem and repeat field problem described above occur, resulting in "feathering". In particular, where titles are prepared from frame data that must be processed in the "3:2 pulldown" method, half of the field combinations includes fields between which a time difference exists. In comparison with the quick motion picture shown on a TV, the quick motion picture shown on a display monitor of noninterlace display system is poor in quality.

BRIEF SUMMARY OF THE INVENTION

Accordingly, an object of the present invention is to provide a computer system and a video decoder that enable a "feathering"—free smooth image to be displayed on the display monitor of a computer by preventing fields between which a time difference exists from being synthesized or combined.

Another object of the present invention is to provide a computer system and a video decoder that enable a "feathering"—free smooth image to be displayed on the display monitor of a computer by means of a simple hardware structure capable of excluding repeat fields from the fields to be combined.

To achieve these objects, the present invention provides a computer system which is provided with a decoder for decoding a video data stream that is in the form of digital compressed codes, which converts video data output from the decoder and adapted for interlace display into video data suitable for noninterlace display, and which displays the resultant video data on a display monitor, the computer system comprising: conversion means for converting the video data adapted for interlace display into the video data suitable for noninterlace display in one of two conversion modes including a field synthesis mode in which a frame for noninterlace display is generated by synthesizing an odd-numbered field and an even-numbered field together, and an interpolation mode in which a frame for noninterlace display is generated by interpolating odd-numbered or even-numbered lines in fields; and switching means for determining whether video data obtained by the decoding by the decoder is field data, or frame data that has to be converted into a plurality of field data in units of one frame, and switching the conversion modes of the conversion means from one to another on the basis of results of determination.

The computer system of the present invention selects a conversion mode in which to convert data from interlace format data to noninterlace format data, by checking the structure of the video data obtained by the decoding by the decoder. The interpolation mode is selected when the video data is field data, and the field synthesis mode is selected when it is frame data. In this manner, the conversion modes can be dynamically switched from one to the other.

In the interpolation mode, lines are interpolated in the fields output from the decoder (an odd-numbered line is added to an even-numbered field, and an even-numbered line is added to an odd-numbered field), and one frame picture is generated from one field picture. Therefore, synthesis of the fields between which a time difference exists can be prevented. The frame data is processed such that data having the same frame number is divided into a plurality of fields. Therefore, with respect to the frames other than those frames from which repeat fields are produced, field data of the same frame number are synthesized in the field synthesis mode, thus preventing synthesis of fields between which a time difference exists.

When the video data decoded by the video decoder is a repeat field produced in the 3:2 pulldown conversion, it is excluded from the data to be subjected to the conversion processing which is executed by the conversion means in the field synthesis mode. Since the repeat fields are skipped when the field synthesis is executed, the repeat field of one frame is not synthesized with the first field of the next frame.

In general, the conversion means is provided as a function of the display controller. In this case, the conversion mode is switched from one to the other by either hardware or software. According to the hardware technique, a switching signal from the video decoder is supplied directly to the display controller. According to the software technique, the CPU receives an interruption signal indicative of the structure of the video data to be supplied to the decoder, and the conversion mode of the display controller is controlled based on software.

The skipping of repeat fields is controlled by either hardware or software. That is, a signal indicative of the generation of a repeat field is supplied from the video decoder to the display controller, and this can be realized based on either a hardware-based or software-based technique.

Where the video decoder has a function of making notification of the structure of video data or the generation of a repeat field, as mentioned above, the conversion function of the display controller (i.e., the conversion from the interlace format to the noninterlace format of display data) can be controlled with high efficiency. Hence, a "feathering"—free smooth image can be shown on the display monitor of a computer.

The present invention also provides a computer system comprising a video decoder for decoding a video data stream that is in the form of digital compressed codes, and a display controller, having a video port for receiving video data for interlace display output from the decoder, for converting the video data received at the video port into video data for noninterlace display in a field synthesis mode in which an odd-numbered field and an even-numbered field are synthesized together to produce a frame for noninterlace display, and for displaying the video data for noninterlace display, the computer system further comprising means for masking a vertical synchronizing signal and a horizontal synchronizing signal received at the video port of the display controller when the video data output from the video decoder is a repeat field produced by 3:2 pulldown conversion.

In this computer system, frame data input to the video decoder is checked to see whether it requires 3:2 pulldown conversion. When the frame data requiring 3:2 pulldown conversion is input, the video decoder executes a decoding operation that involves 3:2 pulldown conversion, and outputs a repeat field periodically. This repeat field is supplied to the video input port of the display controller, and the vertical and horizontal synchronizing signals that are output to the video input port at the time, are masked. Since the vertical and horizontal synchronizing signals are basically used for capturing video data, repeat fields are prevented from being supplied to the video input port by masking the vertical and horizontal synchronizing signals. The repeat fields are thus excluded from the fields to be combined, the simple field synthesis processing is executed by combinations between the two fields of the same frame number. In this manner, a "feathering"—free smooth image can be reproduced on the display monitor of a computer by merely adding a simple hardware component that masks the vertical and horizontal scanning signals.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will now be described with reference to the accompanying drawings.

Figure 1:
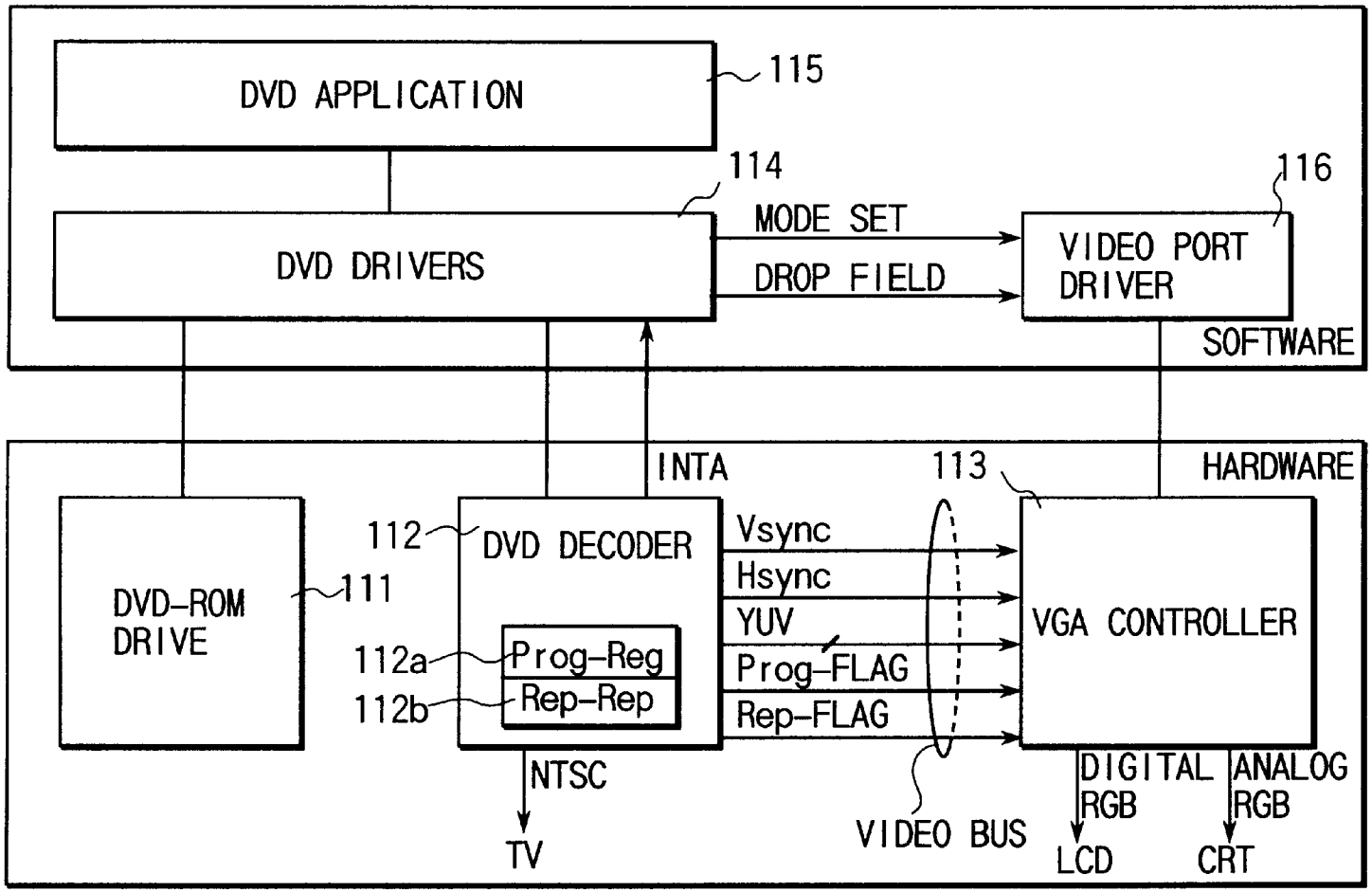
FIG. 1 is a block circuit diagram showing the basic structure of the computer system according to one embodiment of the present invention.

FIG. 1 shows a basic hardware and software structures of a personal computer according to one embodiment of the present invention.

The personal computer is provided with hardware components required for reproducing DVD video information. The hardware components include a DVD-ROM drive 111 capable of accessing both a CD-ROM and a DVD-ROM, a DVD decoder 112 for decoding the DVD video information (incl. video, sub-picture and audio) read out by the DVD-ROM drive 111, and a VGA controller 113 for controlling a display monitor (LCD CRT) for noninterlace display employed in the computer.

Video information serving as DVD video titles are stored in the DVD-ROM. The titles are reproduced from the DVD-ROM by means of DVD drivers 114, a DVD application program 115 and a video port driver 116. The video port driver 116 is a software driver for controlling the digital video input port of the VGA controller 113.

The DVD drivers 114 are software drivers used for the MPEG-2 video control. Based on the instructions sent from the DVD application program 115, the DVD drivers 114 control both the DVD-ROM drive 111 and the DVD decoder 112 to transfer video information from the DVD-ROM drive 111 to the DVD decoder 112.

The video information transferred from the DVD-ROM drive 111 to the DVD decoder 112 is made of an MPEG-2 program stream, and this stream includes encoded video, sub-picture and audio.

As described above, the video data sent to the DVD decoder 112 in the form of an MPEG-2 program stream include two types of data: frame data (progressive data) encoded at a frame rate of 24 Hz, such as a movie film, and field data encoded at a rate of 60 Hz.

In order for the DVD decoder 112 to accurately decode these two types of video data, the MPEG-2 program stream includes a progressive flag and a repeat first field flag as control information.

When the progressive flag is "1", it indicates that the video data to be decoded is frame data for sequential scanning, i.e., the frame data (progressive data) encoded at a frame rate of 24 Hz. When the progressive flag is "0", it indicates that the video data to be decoded is the field data described above.

The repeat first field flag is used for 3:2 pulldown conversion. When the repeat first field flag is "1", it indicates that a repeat field is to be output next.

The DVD decoder 112 is provided with a progressive flag register (Prog-Reg) 112*a* and a repeat first field flag register (Rep-Reg) 112*b*. The progressive flag and the repeat first field flag included in the MPEG-2 program stream are set in registers 112*a* and 112*b*, respectively. These registers 112*a* and 112*b* are used for controlling the decoding operation of the DVD decoder 112 and for notifying external hardware or software of the kind of a decoding operation which is being executed by the DVD decoder 112.

The video data decoded by the DVD decoder 112 is data for interlace display. It is supplied directly to the digital video input port of the VGA controller 113 by way of a dedicated video bus. A vertical synchronizing signal Vsync, a horizontal synchronizing signal Hsync, and digital YUV data are also supplied to the digital video input port of the VGA controller 113, together with the progressive flag signal and repeat first field flag signal. These flag signals are used for controlling the interlace/noninterlace conversion operation executed by the VGA controller 113.

The VGA controller 113 has two modes in which to perform interlace/noninterlace conversion, that is, a simple field synthesis mode and an interpolation mode. In the simple field synthesis mode, two field data that are input in succession (that is, an even-numbered field and an odd-numbered field) are synthesized together, thereby producing one frame data. In the interpolation mode, the line that is not present in an input field (i.e., an odd-numbered line in the case of an even-numbered field, and an even-numbered line in the case of an odd-numbered field) is interpolated, so that one frame picture is produced from one field picture. In this case, a line that should be inserted is obtained, for example, by averaging the successive two lines of an input field in units of one pixel.

The switching between the simple field synthesis mode and the interpolation mode is controlled on the basis of the value of the progressive flag output from the DVD decoder 112.

When the progressive flag is "0" (i.e., when field data is being decoded), the interpolation mode is selected. On the other hand, when the progressive flag is "1" (i.e., when frame data is being decoded), the simple field synthesis mode is selected.

In the simple field synthesis mode, the value of the repeat first field flag is used for determining whether the field data from the DVD decoder 112 should be excluded from the data subjected to field synthesis processing. To be more specific, when the value of the repeat first field flag is "1", the VGA controller 113 does not fetch the field data to be output from the DVD decoder 112 next. As a result, the repeat field is skipped and thus excluded from the field synthesis processing. When the value of the repeat first field flag is "0", two successive fields are synthesized together in the order in which they are input.

This repeat field skipping control can be easily executed by masking the synchronizing signals Vsync and Hsync output from the DVD decoder 112, as will be described later.

The interlace/noninterlace conversion performed by the VGA controller 113 can be performed on the basis of software.

In this case, the DVD decoder 122 regularly issues an interruption signal INTA in response to Vsync of a field data, so as to cause the CPU to execute interruption processing. During this interruption processing, the CPU refers to the progressive flag register (Prog-Reg) 112*a* and the repeat first field flag register (Rep-Reg) 112*b* of the DVD decoder 112. Then, the CPU issues a mode set command (Mode Set) for designating a conversion mode and a drop field command (Drop Field) for designating the skipping of the next field data, and supplies them to the video port driver 116. In this manner, the conversion mode setting and the repeat field skipping control of the VGA controller 113 are executed by use of the video port driver 116. According to the structure shown in FIG. 1, the DVD decoder 112 has a function of making notification of the structure of video data and the output of a repeat field. Since the interlace/noninterlace conversion function of the VGA controller 113 can be controlled with high efficiency, a "feathering"—free smooth image can be displayed on the display monitor of a computer.

The specific system configuration of the personal computer of the embodiment will now be described with reference to FIG. 2.

Figure 2:
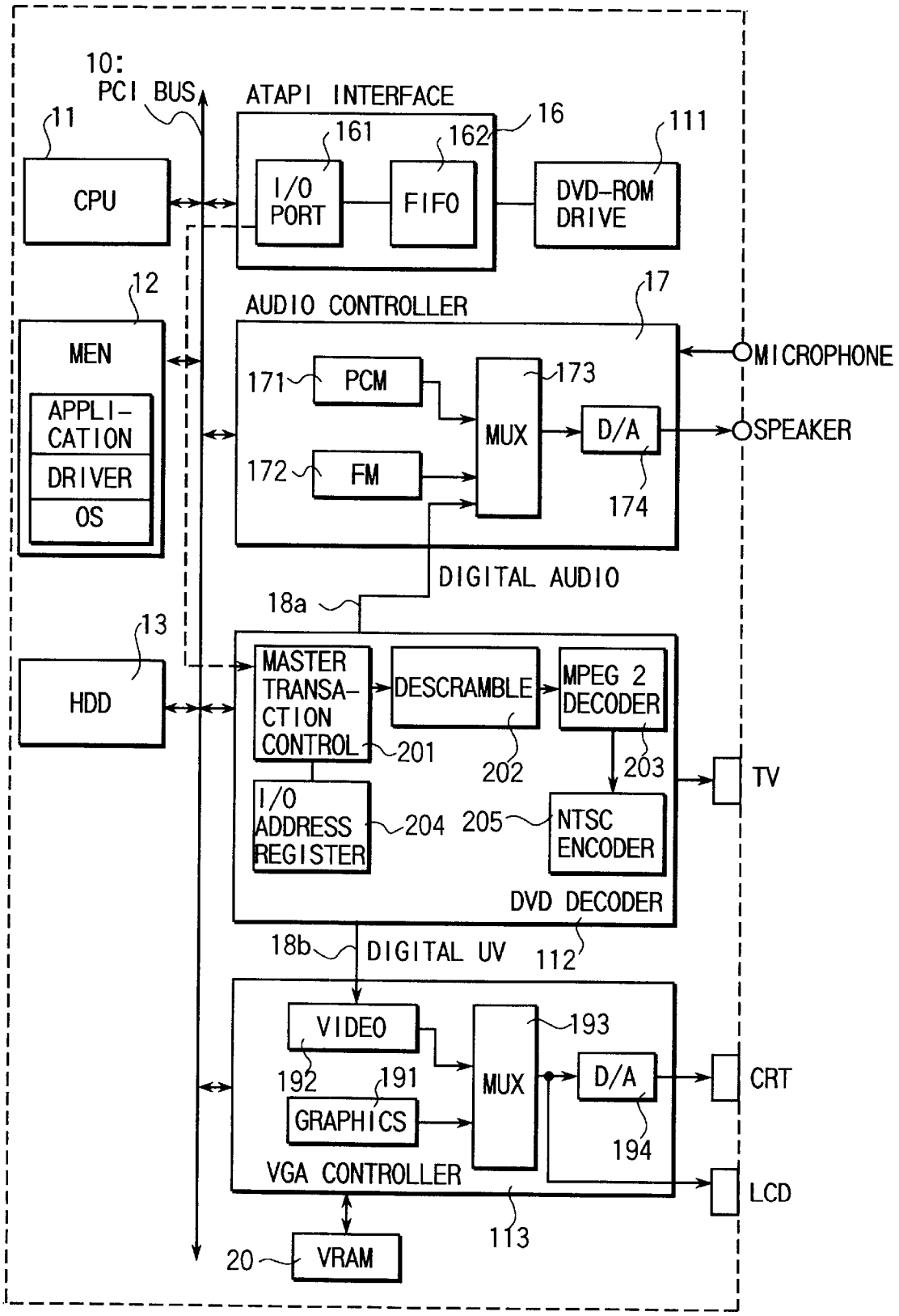
FIG. 2 is a block circuit diagram showing the specific hardware structure of the system of the embodiment.

The system shown in FIG. 2 corresponds to a notebook type personal computer. As shown in FIG. 2, the system comprises a PCI bus 10, CPU 11, a main memory (MEM) 12, an HDD 13, a DVD interface 16 made of either an ATAPI interface or an SCSI interface, and an audio controller 17, in addition to the DVD-ROM drive 111, DVD decoder 112 and VGA controller 113 described above.

Figure 3:
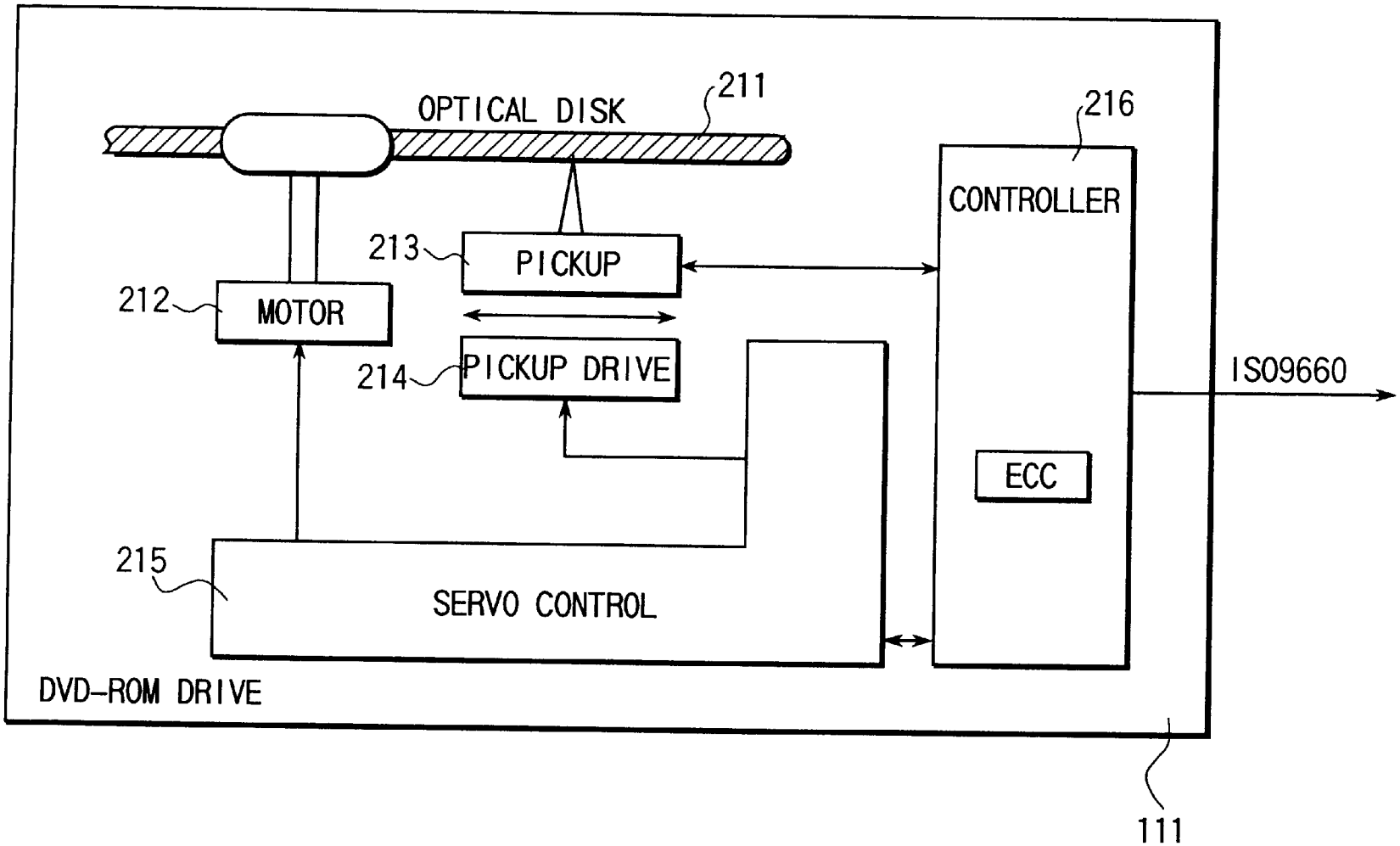
FIG. 3 shows the structure of a DVD-ROM drive employed in the system of the embodiment.

The DVD-ROM drive 111 reads data streams from a DVD-ROM (which is capable of storing about 10 GB of data by use of its both sides) at a maximum transfer rate of 10.8 Mbps. As shown in FIG. 3, the DVD-ROM drive 111 comprises DVD media 211, a motor 212, a pickup 213, a pickup drive 214, a servo controller 215, and a drive controller 216 (which includes an ECC circuit for error detection and correction). The motor 212, the pickup 213, the pickup drive 214, the servo controller 215 and the drive controller 216 jointly function as a drive apparatus for driving the DVD media 211 and reading data therefrom.

The DVD-ROM media 211 can store movie information of about 135 minutes on one side. The movie information can contain a main video, sub pictures (sub fields) corresponding to up to 16 channels, and audios corresponding to up to 32 channels.

The video data, the sub-picture data and the audio data are recorded after being compressed as digital codes according to the MPEG-2 format. According to MPEG-2 standards, the data encoded according to MPEG-2 can include other encoded data, and these two kinds of encoded data can be dealt with as one MPEG-2 program story.

MPEG-2 is used for encoding video data, while run-length encoding and Dolby digital system are used for encoding sub-picture data and audio data, respectively. Even in this case, the encoded video data, the sub-picture data and the audio data are dealt with as one MPEG-2 program stream.

The encoding processing based on the MPEG-2 standards is variable-rate encoding, and the amount of information recorded or reproduced per unit time can be controlled.

In the case of a quick motion scene, the transfer rate of the MPEG stream constituting the corresponding frames is increased, thereby enabling reproduction of high-quality motion picture.

Figure 4:
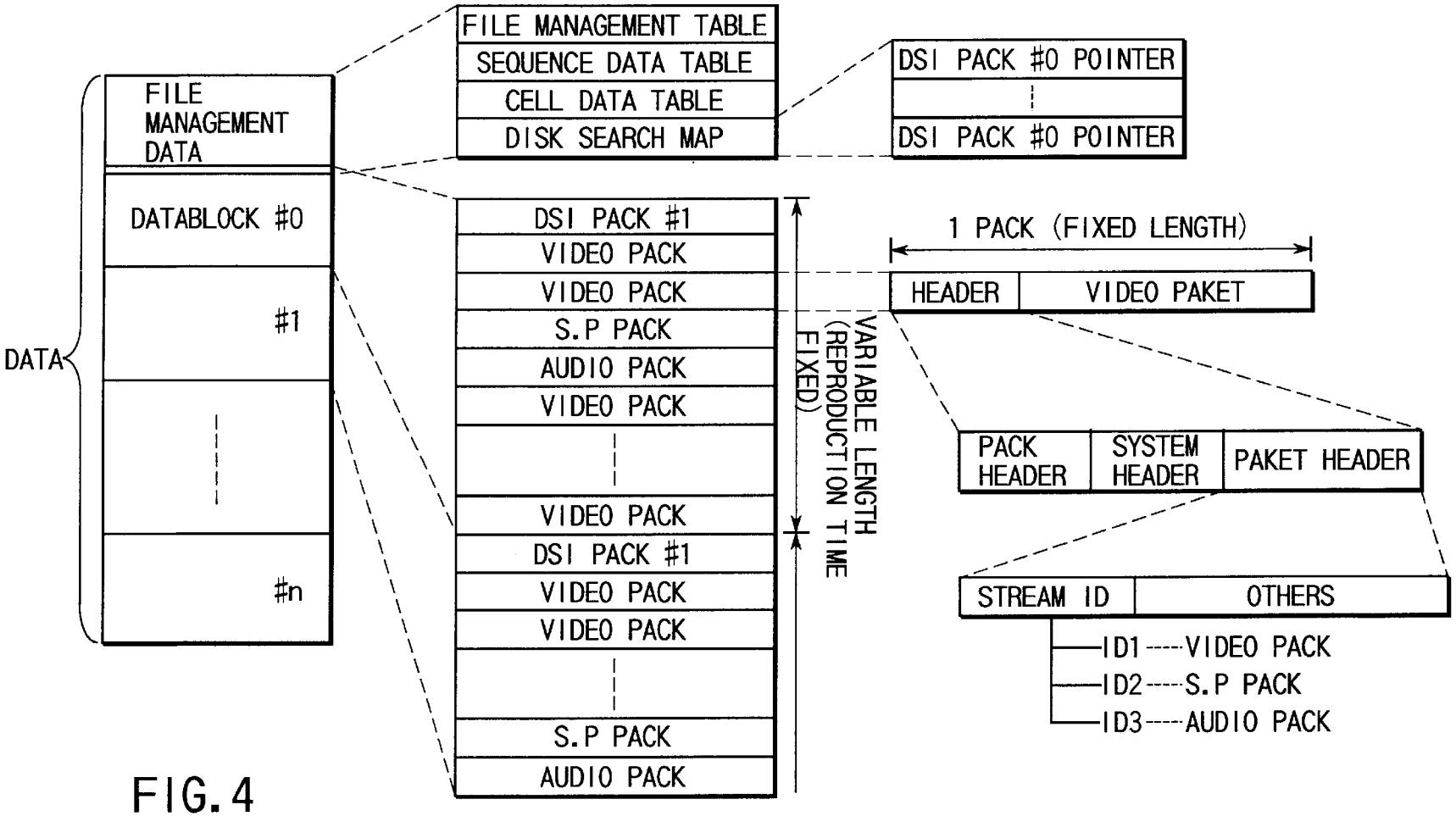
FIG. 4 shows an example of a recording format of motion picture data used in the system of the embodiment.

To make good use of the features of MPEG-2, this embodiment of the present invention adopts the data format shown in FIG. 4 so as to record a movie title or another title on the DVD media 211.

As shown in FIG. 4, one title is made up of a file management information section and a data section. The data section contains a large number of data blocks (blocks #0 to #n). A DSI (disk search information) pack is at the head of each data block, and the data from one DSI pack to the next DSI pack constitutes one data block.

The storage area of each DSI pack is managed by the disk search map information of the file management information section.

One data block constitutes information of 15 frames which are required for reproducing a motion picture for a predetermined length of time (e.g., 0.5 seconds), and thus corresponds to a GOP (Group Of Picture). In each data block, a video pack (VIDEO pack), a sub-picture pack (S.P. pack) and an audio pack (AUDIO pack) are multiplexed and recorded. The video pack (VIDEO pack), the sub-picture pack (S.P. pack) and the audio pack (AUDIO pack) are units of encoded video, sub-picture and audio, respectively. The data size of each pack corresponds to the sector size described above, and is thus fixed. However, the number of packs included in one data block can be varied. Hence, a data block corresponding to a quick motion scene contains a large number of video packs.

Each of the video pack, sub-picture pack and audio pack is made up of a header section and a packet section (a video packet, a sub-picture packet and an audio packet). The packet section is the encoded data itself. The header section includes a pack header, a system header and a packet header, and a stream ID indicating the type of the packet (i.e., the video packet, the sub-picture packet, and the audio packet) is registered in the packet header.

The encoded data recorded in a DVD can be scrambled based on a predetermined encryption algorithm. For example, the encoded data in an arbitrary sector can be scrambled, so as to prevent the title from being copied illegally.

DVD has a multi-story function and a multi-angle function as well. According to the multi-story function, the user designates one scenario from a number of scenarios, and a group of scenes corresponding to the designated scenario are reproduced. According to the multi-angle function, the user designates one photographing angle from among a number of photographing angles, and the images photographed at the designated angle are selected and reproduced.

These functions are realized by multiplexing a plurality of images corresponding to the multi-story and multi-angle in units of e.g. one data block, and by managing the positions or associations of the data blocks according to each story or angle on the basis of the disk search map information.

The units employed in the system shown in FIG. 2 will now be described.

The CPU 11 controls the operation of the entire system and executes the operating system stored in the system memory (MEM) 12 and an application program designated by the user. The transfer or reproduction of the data recorded in the DVD-ROM media is performed by causing the CPU 11 to execute the DVD drivers 114, the DVD application program 115 and the video port driver 116.

The DVD interface 16 is a disk interface through which a disk drive, such as a HDD or a CD-ROM drive, is connected to the PCI bus 10. In the present embodiment, the DVD interface 16 performs data transfer with reference to the DVD-ROM drive 111 on the basis of an instruction supplied from the CPU 11. The DVD interface 16 is provided with an FIFO buffer 162 for temporarily storing data read out by the DVD-ROM drive 111, and an I/O port 161 for transferring data from the FIFO buffer 162 to the PCI bus 10. The I/O port 161 is made of an I/O register which can be read by a bus master device, which issues an I/O read transaction and sends it to the PCI bus 10.

The audio controller 17 performs the input/output control of sound data under the control of the CPU 11. To generate sound, the audio controller 17 comprises a PCM sound source 171, an FM sound source 172, a multiplexer 173 and a D/A converter 174. The multiplexer 173 receives an output of the PCM sound source 171, an output of the FM sound source 172, and digital audio data transferred from the DVD decoder 18, and selects one of these.

The digital audio data is obtained by decoding the audio data read out by the DVD-ROM drive 111. An audio bus 18*a* is used for transferring digital audio data from the DVD decoder 112 to the audio controller 17, and the PCI bus 10 is not used for this purpose. Therefore, digital audio data can be transferred at high speed without adversely affecting the performance of the computer system.

The DVD decoder 112 reads an MPEG-2 program stream from the DVD interface 16 under the control of the CPU 11, and divides it into a video packet, a sub-picture packet, and an audio packet. Thereafter, the DVD decoder 112 decodes the packets and output them synchronously. The DVD decoder 112 is in the form of a chip set mounted on the system board of the computer system. As shown in FIG. 2, the DVD decoder 112 is made up of a master transaction controller 201, a descramble controller 202, an MPEG-2 decoder 203 and an I/O address register 204.

The master transaction controller 201 allows the DVD decoder 112 to function as a bus master (initiator), which issues a transaction and sends it to the PCI bus 10. The master transaction controller 201 executes I/O read transaction which is for reading out motion-picture data from the DVD interface 16. In this case, the I/O read transaction includes an address phase for designating the I/O port 161 of the DVD interface 16 and at least one data transfer phase following the address phase, and thus enables motion-picture data to be read by burst transfer. An I/O address value for designating the I/O port 161 is set in the I/O address register 204 by the CPU 11.

An MPEG-2 program stream read by the master transaction controller 201 is sent to the MPEG-2 decoder 203 through the descramble controller 202. The descramble controller 202 decodes the scrambled data and restores it into an original state (descramble processing). The MPEG-2 decoder 203 separates the video, sub-picture and audio packets from the MPEG-2 program stream and decodes the packets.

Decoded audio data is transferred to the audio controller 17 by way of the audio path 18*a*, as described above. Decoded video and sub picture are synthesized with each other, and data obtained thereby is sent to the VGA controller 113 as digital YUV data. A dedicated video bus 18*b* is used for transferring the digital YUV data from the DVD decoder 112 to the VGA controller 113, and the PCI bus 10 is not used for this purpose. Like the digital audio data, therefore, the digital YUV data can be transferred at high speed without adversely affecting the performance of the computer system. A ZV port can be used for the audio bus 18*a* or the video bus 18*b*.

The DVD decoder 112 incorporates an NTS encoder 205 and therefore has a function of converting digital YUV data and audio data into NTSC-system TV signals and outputting these TV signals to an external TV receiver.

Under the control of the CPU 11, the VGA controller 113 controls an LCD or an external CRT display which is employed as the display monitor of the system. The VGA controller 113 supports not only display of VGA text and graphic data but also display of motion-picture data.

As shown in FIG. 2, the VGA controller 113 comprises a graphics display control circuit (GRAPHICS) 191, a video display control circuit 192, a multiplexer 193, a D/A converter 194, etc.

The graphics display control circuit 191 is a VGA-compatible graphics controller. It converts VGA graphics data developed in a video memory (VRAM) 20 into RGB video data, and outputs this data. The video display control circuit 192 serves as an interface with reference to the digital video input port mentioned above. The video display control circuit 192 has a function of performing interlace/noninterlace conversion by using the video buffer of either the video memory (VRAM) 20 or the video display control circuit 192, a function of converting YUV data, which is frame data for noninterlace display, into RGB video data.

The multiplexer 193 selects either output data from the graphics display control circuit 191 or output data from the video display control circuit 192. Alternatively, the multiplexer 193 synthesizes a video output from the video display control circuit 192 with VGA graphics from the graphics display control circuit 191, and outputs the resultant video data to the LCD. The D/A converter 194 converts video data from the multiplexer 194 into an analog RGB signal and outputs the analog RGB signal to the CRT display.

Figure 5:
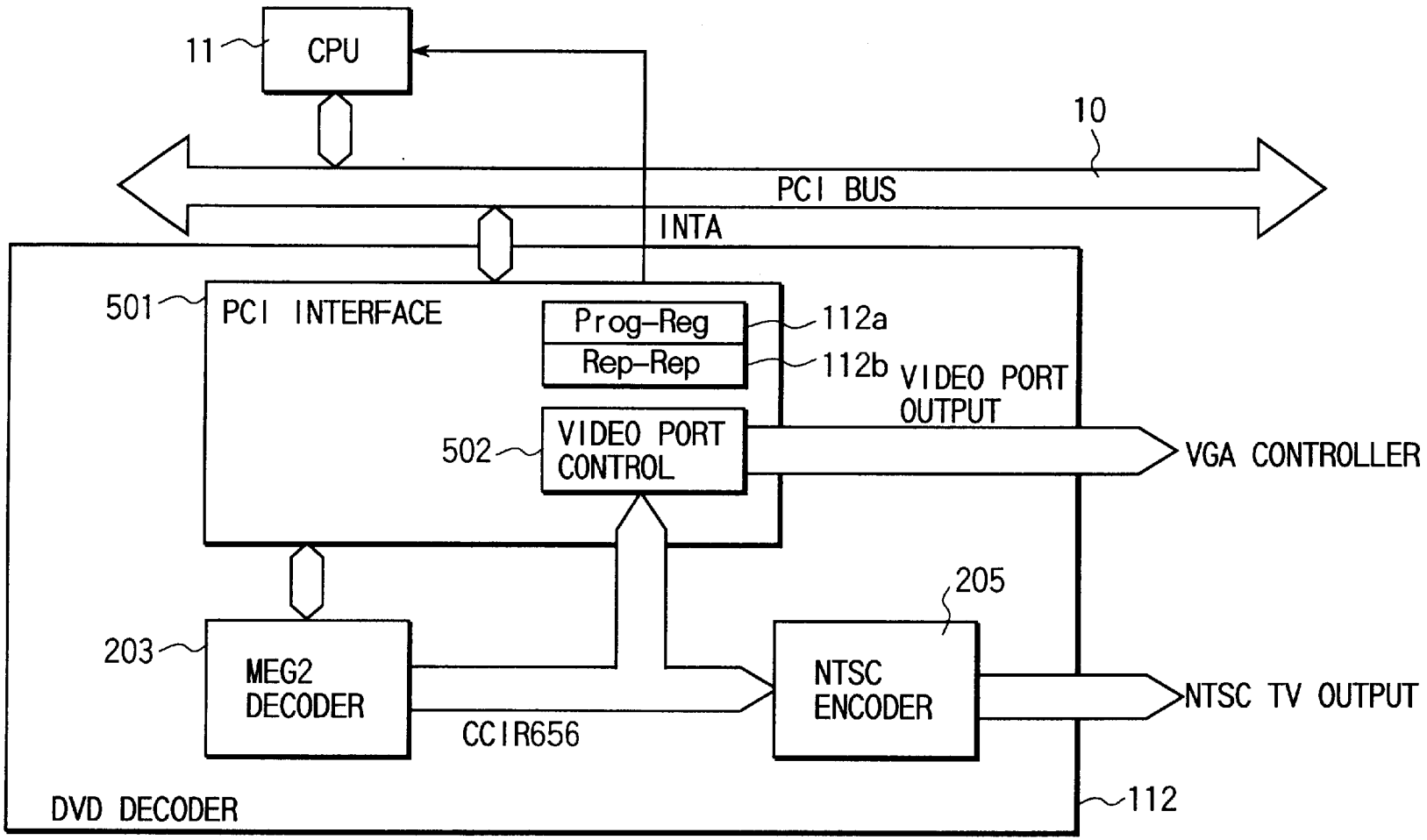
FIG. 5 shows how the units of the DVD decoder employed in the system of the embodiment are connected to one another.

FIG. 5 shows how the units of the DVD decoder 112 are connected to one another.

A PCI interface unit 501, shown in FIG. 5, is made up of the master transaction controller 201, the descramble controller 202 and the I/O address register 204 described above. An MPEG-2 program stream descrambled by the PCI interface unit 501 is supplied to an MPEG-2 decoder 203, for decoding. The MPEG-2 decoder 203 interprets the progressive flag and the repeat first field flag, both included in the MPEG-2 program stream, and executes the decoding operation on the basis of the results of interpretation. The results of interpretation of the progressive flag and the repeat first field flag are set in the progressive flag register (Prog-Reg) 112*a* and the repeat first. field flag register (Rep-Reg) 112*b* of the PCI interface unit 501, respectively.

Video data decoded by the MPEG-2 decoder 203 is supplied to the NTSC encoder 205, and also to a video port control circuit 502 incorporated in the PCI interface unit 501. The video port control circuit 502 converts video data output from the MPEG-2 decoder 203 into data having a data format which is suitable for output to the video port of the VGA controller 113. The vertical synchronizing signal Vsync, horizontal synchronizing signal Hsync, digital YUV data, progressive flag signal and repeat first field flag signal, which were explained above with reference to FIG. 1, are supplied to the video port of the VGA controller 113 by way of the video port control circuit 502. The progressive flag signal and repeat first field flag signal supplied to the VGA controller 113 indicate the contents of the progressive flag register (Prog-Reg) 112*a* and the repeat first field flag register (Rep-Reg) 112*b*.

A description will now be given of a specific operation for controlling the interlace/noninterlace conversion.

First, a description will be given with reference to FIG. 6 as to how the interlace/noninterlace conversion is controlled for solving the field picture problem mentioned above.

To display field data, the VGA controller 113 is switched to the interpolation mode, and lines which should be added to field pictures are interpolated (an odd-numbered line in the case of an even-numbered field, and an even-numbered line in the case of an odd-numbered field). By this interpolation, one frame picture can be generated from one field picture and displayed. Accordingly, fields between which a time difference exists are not synthesized. However, some titles contain both frame data (progressive data) and field data. During reproduction of such titles, the conversion mode must be dynamically switched from the simple field synthesis mode to the interpolation mode. By this mode switching, field data can be displayed without giving rise to a "feathering" phenomenon. The method for switching will be described in detail below.

[Case Where Progressive Flag Signal Is Used]

Figure 6:
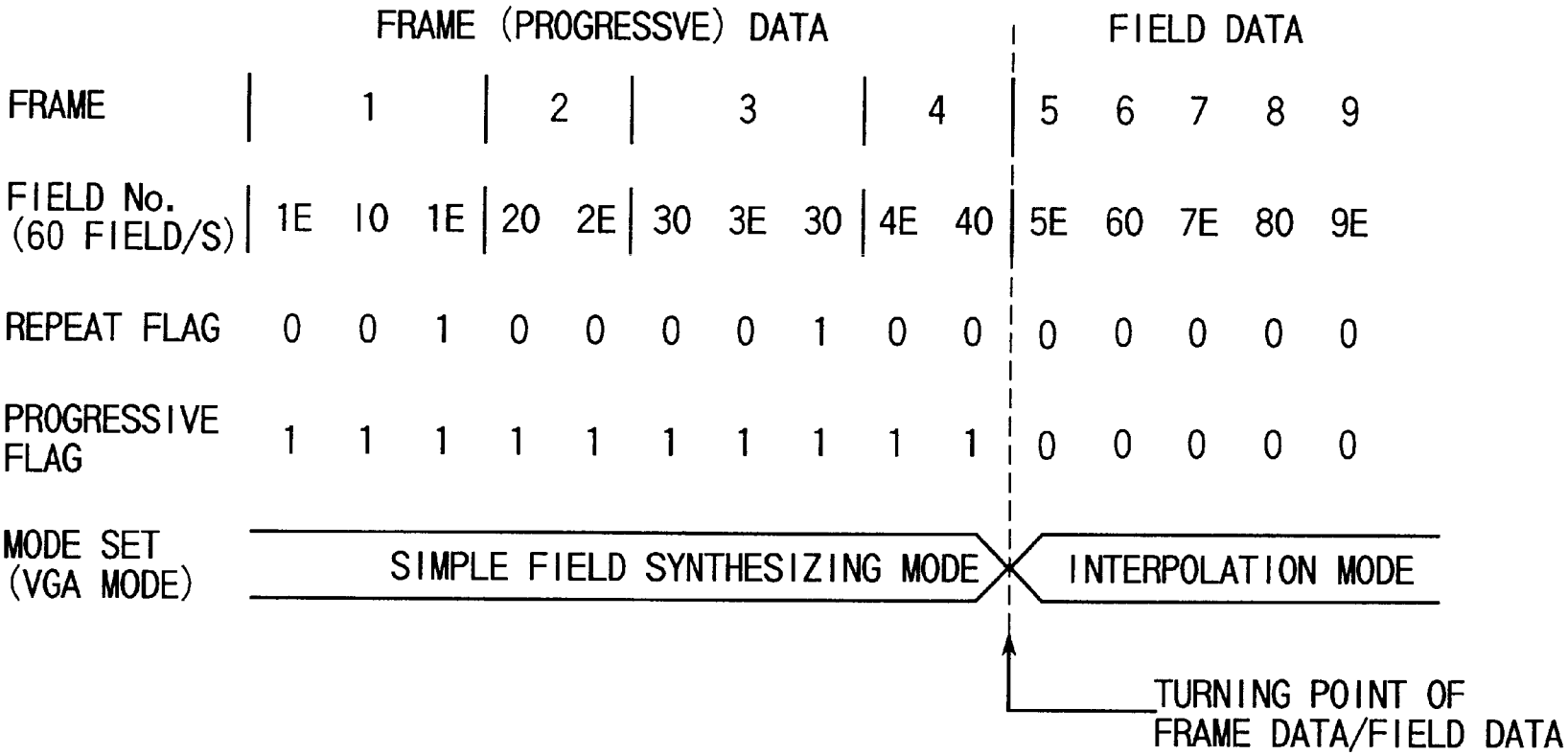
FIG. 6 is a timing chart illustrating a mode switching operation executed in the system of the embodiment for interlace/noninterlace conversion.

FIG. 6 shows how the data to be processed changes from frame data to field data and how the conversion mode is switched from one to the other.

Referring to FIG. 6, "Frame No." indicates the frame number of frame data (24 frames/sec) which is not yet decoded, and field data (60 fields/sec). "Field No." indicates the field number of field data (60 fields/sec) which is already decoded and corresponds to NTSC. The suffix letter "E" of the field number indicates that the field is even-numbered, while the suffix letter "O" indicates that the field is odd-numbered.

When frame data (24 frames/sec) are decoded, the progressive flag register (Prog-Reg) 112*a* is set to "1". When field data (60 frames/sec) are decoded, the progressive flag register (Prog-Reg) 112*a* is reset to "0".

The DVD decoder 112 decodes video data, while simultaneously determining whether the video data to be decoded is frame data or field data by referring to the progressive flag contained in the MPEG-2 program stream. When the frame data is decoded, the DVD decoder 112 also adjusts the frame rate by 3:2 pulldown conversion. The video port control circuit 502 of the DVD decoder 112 outputs digital YUV data (i.e., the results of decoding) and a progressive flag signal to the video port of the VGA controller 113 along with synchronizing signals Vsync and Hsync.

The VGA controller 113 samples the progressive flag signal output from the video port control circuit 502 of the DVD decoder 112 each time signal Vsync is output. Upon detection of the progressive flag signal being asserted to be "1", the VGA controller 113 starts interlace/noninterlace conversion in the simple field synthesis mode. Upon detection of the progressive flag signal being deasserted to be "0", the VGA controller 113 switches the conversion mode to the interpolation mode.

[Case Where Progressive Flag Signal Is Not Used]

The DVD decoder 112 decodes video data, while simultaneously determining whether the video data to be decoded is frame data or field data by referring to the progressive flag contained in the MPEG-2 program stream. When the frame data is decoded, the DVD decoder 112 also adjusts the frame rate by 3:2 pulldown conversion. The DVD decoder 112 issues an interruption signal INTA in synchronism with the output of signal Vsync. The interruption signal INTA is supplied to the CPU 11 through hardware components, such as a rooter and an interruption controller. As a result, an interruption routine for DVD drivers 114 is executed.

In the interruption routine, the progressive flag register (Prog-Reg) 112*a* of the DVD decoder 112 is referred to. If the progressive flag is set at "1", a mode set command (ModeSet) is issued and sent to the video port driver 116, so as to switch the conversion mode of the VGA controller 113 to the simple field synthesis mode. Upon receipt of the mode set command (ModeSet), the video port driver 116 writes conversion mode setting information in the VGA controller 113 and switches the conversion mode to the simple field synthesis mode. When the progressive flag is reset to "0", the interruption processing routine issues a mode set command (ModeSet) and sends it to the video port driver 116, so as to switch the conversion mode of the VGA controller 113 to the interpolation mode. Upon receipt of the mode set command, the video port driver 116 writes conversion mode setting information in the VGA controller 113, and switches the conversion mode from the simple field synthesis mode to the interpolation mode.

Figure 7:
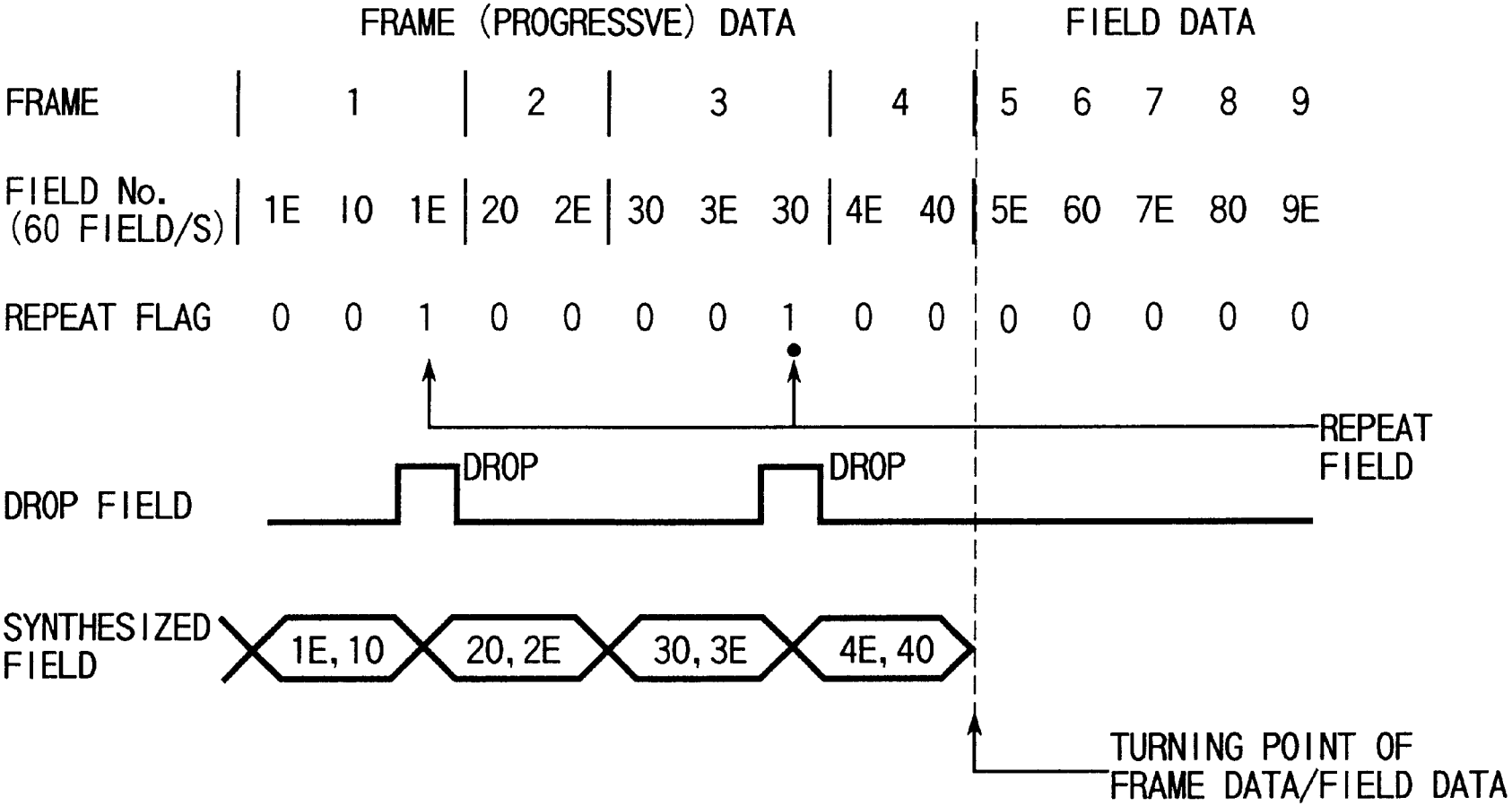
FIG. 7 is a timing chart illustrating how repeat field skipping is controlled by the system of the embodiment.

Next, a description will be given with reference to FIG. 7 as to how the interlace/noninterlace conversion is controlled for solving the repeat field problem described above.

When frame data (progressive data) of 24 frames/sec is decoded, frame data of 24 frames/sec is converted into field data of 60 fields/sec in the 3:2 pulldown method. As shown in FIG. 7, in this 3:2 pulldown conversion, the third field of the first frame is a repeat field. i.e., a repetition of the first field (1E), and the third field of the third frame is also a repeat field, i.e., a repetition of the first field (3O).

What becomes a problem with the simple field synthesis processing is the combination of field data prepared from frame data of different frame numbers. Therefore, the repeat field problem can be solved by skipping the repeat fields such that they are not subjected to the simple field synthesis processing. A description will be given of the method for controlling the skipping of repeat fields.

[Case Where Repeat First Field Flag Is Used]

When the video data to be decoded is frame data, the DVD decoder 112 determines the timing at which a repeat field is generated on the basis of a repeat first field flag included in the MPEG-2 program stream. Then, the DVD decoder 112 starts decoding the video data while simultaneously adjusting the frame rate by the 3:2 pulldown conversion. In FIG. 7, a repeat first field flag and a repeat field are illustrated as being generated at the same time. In practice, however, the repeat first field flag is set during the latter half of the first field (i.e., the field which should be repeated) and is reset during the first half of the second field.

The video port control circuit 502 of the DVD decoder 112 outputs digital YUV data (i.e., the results of decoding) and a first repeat field flag signal, and supplies them to the video port of the VGA controller 113 along with synchronizing signals Vsync and Hsync. The first repeat field flag signal corresponds to the data stored in the repeat first field flag register (Rep-Reg) 112*b*, and indicates whether or not a repeat field is output next.

The VGA controller 113 samples the repeat first field flag signal output from the video port control circuit 502 of the DVD decoder 112 each time signal Vsync is output. Upon detection of the repeat first field flag signal being asserted to be "1", the VGA controller 113 does not capture the next field (i.e., the repeat field). Since the repeat field is excluded from the field synthesis processing, the simple field synthesis processing is executed on the basis of the combination between the two fields of the frame of the same frame number.

To be more specific, the VGA controller 113 produces one frame by synthesizing the first and second fields (1E, 1O) of the first frame together. The VGA controller 113 does not fetch data on the third field (1E) of the first frame since the third field is a repeat field. Then, the VGA controller 113 produces the second frame by synthesizing the first and second fields (2O, 2E) of the second frame. In this manner, a "feathering"—free image is attained by skipping the repeat fields.

[Case Where Repeat First Field Flag Is Not Used]

When the video data to be decoded is frame data, the DVD decoder 112 determines the timing at which a repeat field is generated on the basis of a repeat first field flag included in the MPEG-2 program stream. Then, the DVD decoder 112 starts decoding the video data while simultaneously adjusting the frame rate by the 3:2 pulldown conversion. The DVD decoder 112 issues an interruption signal INTA in synchronism with the output of signal Vsync. The interruption signal INTA is supplied to the CPU 11 through hardware components, such as a rooter and an interruption controller. As a result, an interruption routine for DVD drivers 114 is executed.

In the interruption routine, the repeat first field flag 112*b* of the DVD decoder 112 is referred to. If this repeat first field flag is set at "1", a drop field command (Drop Field) is issued and supplied to the video port driver 116. In response to this command, the video port driver 116 writes video data capture prohibition information in the VGA controller 113, so as not to capture the next field data.

Figure 8:
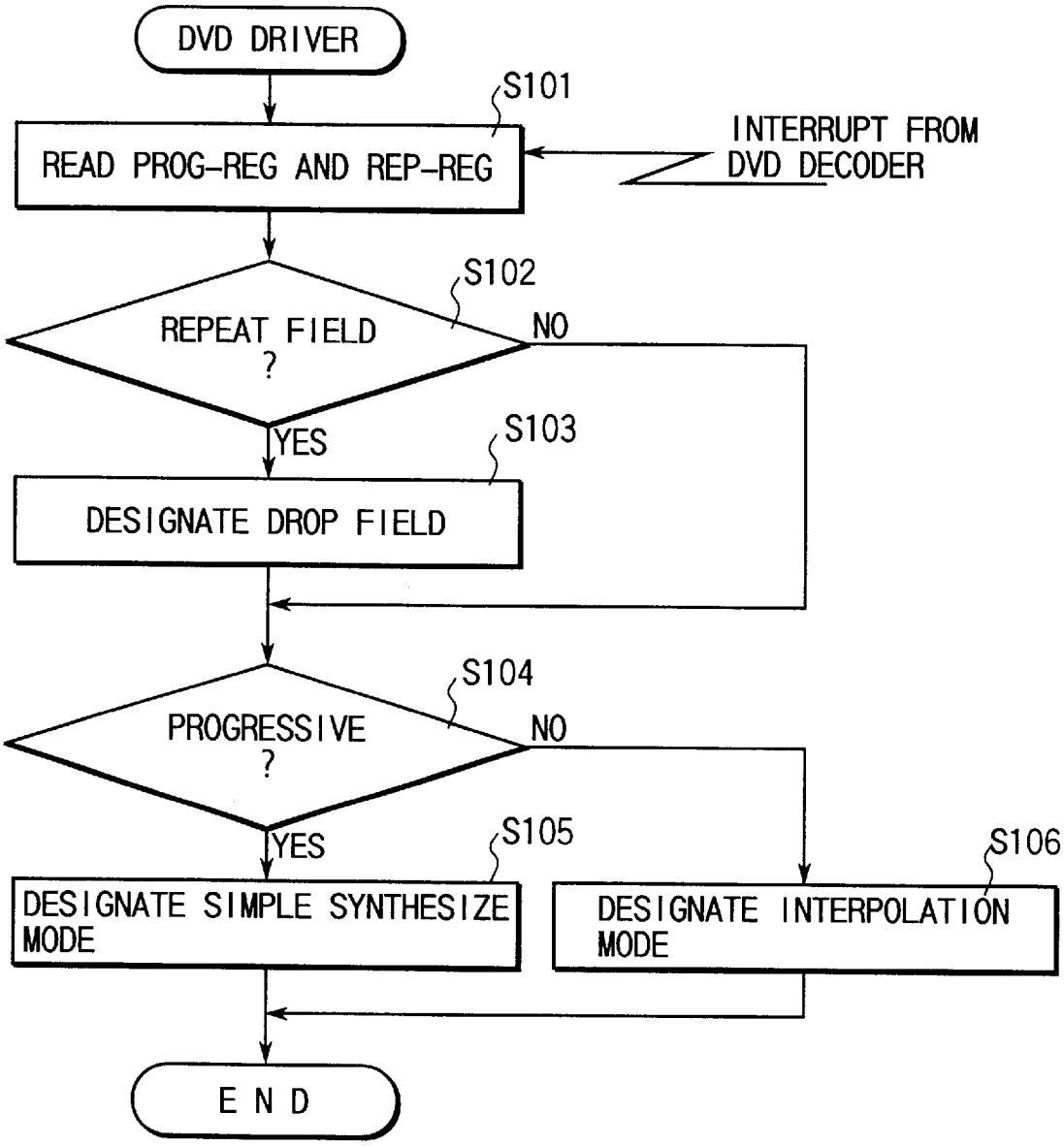
FIG. 8 is a flowchart showing how the interlace/noninterlace conversion mode is switched and repeat field skipping is controlled based on the software used in the system of the embodiment.

An interruption processing routine executed in response to an interruption signal from the DVD decoder 112 will be described with reference to the flowchart shown in FIG. 8.

At the start of the interruption processing routine, the progressive flag register (Prog-Reg) 112*a* and the repeat first field flag register (Rep-Reg) 112*b* are read, and a check is made to see whether the repeat first field flag is set at "1" (Step S101). If the repeat first field flag is set at "1", the interruption processing routine issues a drop field command so as not to capture the next field data (Step S103). Subsequently, the progressive flag is checked to see whether it is "1" or "0". If it is "1", the simple synthesis mode is designated by means of the mode set command. If it is "0", the interpolation mode is designated by the mode set command. (Steps S104, S105 and S106)

Figure 9:
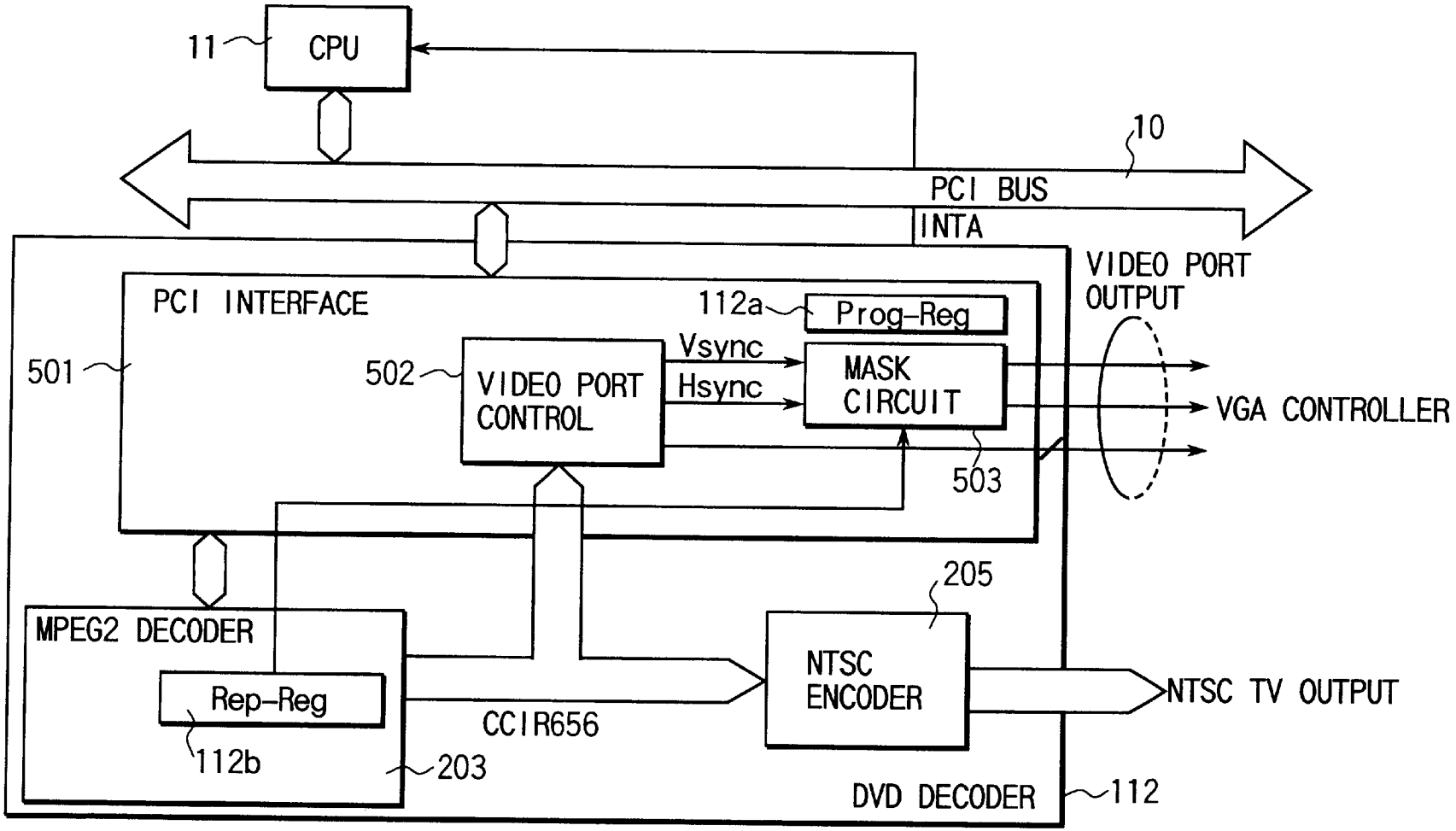
FIG. 9 is a block circuit diagram showing another example of a structure of the DVD decoder employed in the system of the embodiment.

FIG. 9 shows another example of a structure of the DVD decoder 112 designed to solve the repeat field problem.

Referring to FIG. 9, a mask circuit 503 is arranged at the output end of the video port control circuit 502 of a PCI interface unit 501. The mask circuit 503 masks synchronizing signals Vsync and Hsync output from the video port control circuit 502 and is controlled on the basis of the value of the data stored in a repeat first field flag register (Rep-Reg) 112*b*.

The mask circuit 503 receives the value of the repeat first field flag register 112*b* in synchronism with signal Vsync output from the video port control circuit 502. If the value of the repeat first field flag is "1", the signals Vsync and Hsync corresponding to the next field are masked. When signal Vsync is generated next, the signals Vsync and Hsync are automatically released from the masked state.

Basically, signals Vsync and Hsync are used as start signals in response to which the VGA controller 113 starts capturing video data from the video port. When signals Vsync and Hsync are masked, the data generated in the meantime is not captured. Therefore, repeat fields can be eliminated and fields between which a time difference exists are prevented from being combined together by causing the mask circuit 503 to mask the signals Vsync and Hsync corresponding to the repeat fields. The manner in which this operation is performed is shown in FIG. 10.

Figure 10:
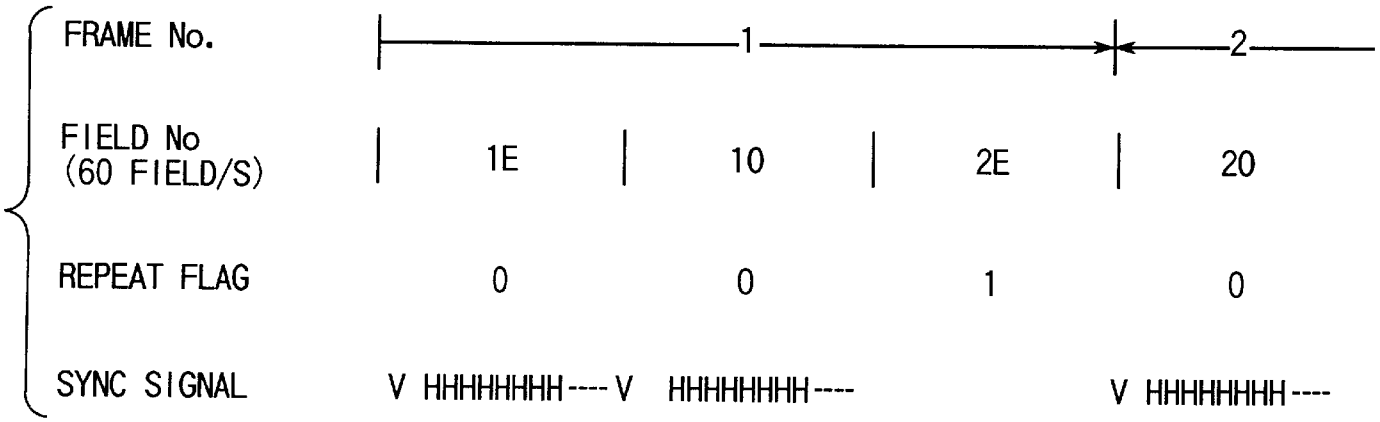
FIG. 10 is a timing chart showing how a repeat field skipping control operation is performed by the DVD decoder shown in FIG. 10.
Figure 11:
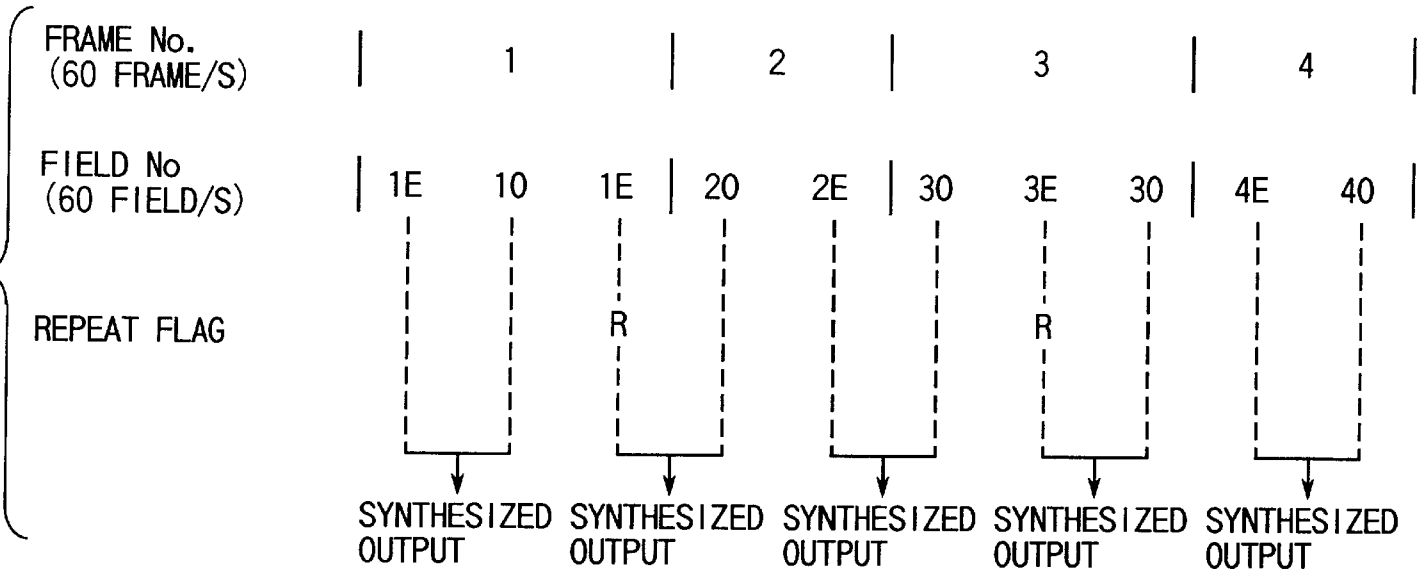
FIG. 11 is a timing chart showing a conventional conversion interlace/noninterlace conversion operation.

Referring to FIG. 10, the third field (1E) of the first frame is a repeat field, and signal Vsync corresponding thereto and subsequent signals Hsync are masked by the mask circuit 503. Accordingly, the third field (1E) of the first frame is skipped and is not therefore captured by the VGA controller 113. The masking is automatically released when signal Vsync is generated next. Hence, the first field (2E) of the second frame is captured by the VGA controller 113 and used in the field synthesis processing.

As described above, the structure shown in FIG. 9 does not use a repeat first field flag or an interruption signal. Instead, signals Vsync and Hsync are masked to exclude repeat fields from the field synthesis processing. The structure shown in FIG. 9 is advantageous in that it can solve the repeat field problem with no need to provide a specially-designed signal line, etc.

When the structure shown in FIG. 9 was explained, reference was made to the case where all signals Hsync generated in the repeat field generation period are masked, in addition to signal Vsync. The reason for masking all signals Hsync is to prevent video data from being mistakenly written in the off-screen area of a frame buffer or in a display screen area that is not intended for video display.

As described above, according to the embodiment, the DVD decoder 112 is provided with a function of making notification of a video data structure (frame/field) and a function of designating the skipping of repeat fields. Even when a video stream is scrambled, the functions can be realized by using the flags included in the scrambled video stream. Accordingly, fields between which a time difference exists are prevented from being synthesized together, without giving any adverse effects on the copy protect function. The repeat filed problem can be solved by masking signals Vsync and Hsync. In this case, the video on the display monitor can be displayed with high quality by merely adding a simple hardware component.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display control device comprising:

a decoder configured to decode video contents data to produce television field data wherein the video contents data includes at least one of interlace field data and progressive frame data, the video contents data further including a progressive flag indicating whether the video contents data is interlace field data or progressive frame data, the decoder further configured to output the television field data and the progressive flag to a graphic controller, wherein:

the graphic controller is connected to the decoder and configured to convert the television field data into non-interlace frame data based on the progressive flag such that one non-interlace frame data is synthesized based on two television field data if the progressive flag indicates that the video contents data is progressive frame data and one non-interlace frame data is synthesized by interpolating one television field data if the progressive flag indicates that the video contents data is interlace field data, the video contents data further includes a repeat flag indicating whether repeat field data is to be output from the decoder, the decoder is further configured to output the repeat flag to the graphic controller, the graphic controller is further configured to skip the television field data for conversion if the repeat flag indicates that the repeat field data is to be output, the decoder is further configured to output a vertical sync signal to the graphic controller and, if the repeat flag indicates that the repeat field data is to be output, to mask the vertical sync signal, the graphic controller is further configured to capture the television field data based on the vertical sync signal, the decoder is further configured to output a horizontal sync signal to the graphic controller and, if the repeat flag indicates that the repeat field data is to be output, to mask the horizontal sync signal, and the graphic controller is further configured to capture the television field data based on the horizontal sync signal.

2. A display control device comprising:

a decoder configured to decode video contents data to produce television field data wherein the video contents data includes at least one of interlace field data and progressive frame data and output television field data, the video contents data further including a repeat flag indicating whether repeat field data is to be output from the decoder, the decoder further configured to output the television field data and the repeat flag to a graphic controller, wherein:

the graphic controller is connected to the decoder and configured to convert the television field data into non-interlace frame data based on the repeat flag such that the graphic controller skips the television field data for conversion if the repeat flag indicates that repeat field data is to be output, the decoder is further configured to output a vertical sync signal to the graphic controller and, if the repeat flag indicates that the repeat field data is to be output, to mask the vertical sync signal, the graphic controller is further configured to capture the television field data based on the vertical sync signal, the decoder is further configured to output a horizontal sync signal to the graphic controller and, if the repeat flag indicates that the repeat field data is to be output, to mask the horizontal sync signal, and the graphic controller is further configured to capture the television field data based on the horizontal sync signal.

3. A display control device comprising:

a decoder configured to decode video contents data to produce television field data wherein the video contents data includes interlace field data and a repeat flag indicating whether television field data is to be output from the decoder, the decoder further configured to output the television field data, the repeat flag, and a vertical sync signal to the mask circuit;

a mask circuit, connected to the decoder, configured to mask the vertical sync signal if the repeat flag indicates that the television field data is not output; and a graphic controller, connected to the mask circuit, configured to capture the television field data based on the vertical sync signal and synthesize two television field data to produce a frame signal, wherein:

the decoder is further configured to output a horizontal sync signal to the mask circuit, and the mask circuit is further configured to mask the horizontal sync signal if the repeat flag indicates that the television field data is not output.

4. A method for displaying an image, the method comprising:

decoding video contents data to produce television field data wherein the video contents data includes at least one of interlace field data and progressive frame data, the video contents data further including a progressive flag indicating whether the video contents data is interlace field data or progressive frame data; and outputting the television field data and the progressive flag and then converting the television field data into non-interlace frame data based on the progressive flag such that one non-interlace frame data is synthesized based on two television field data if the progressive flag indicates that the data is the progressive frame data and one non-interlace frame data is synthesized by interpolating one television field data if the progressive flag indicates that the data is the interlace field data, wherein:

the video contents data further includes a repeat flag indicating whether a repeat field data is to be output, the repeat flag is output, the television field data is skipped for converting if the repeat flag indicates that the repeat field data is to be output, a vertical sync signal is output and, if the repeat flag indicates that the repeat field data is to be output, the vertical sync signal is masked, the television field data is captured for converting based on the vertical sync signal, a horizontal sync signal is output and, if the repeat flag indicates that the repeat field data is to be output, the horizontal sync signal is masked, and the television field data is captured when converting based on the horizontal sync signal.

5. A method for displaying an image, the method comprising:

decoding video contents data to produce television field data wherein the video contents data includes at least one of interlace field data and progressive frame data, the video contents data further including a repeat flag indicating whether a repeat field data is to be output from the decoder; and outputting the television field data and the repeat flag and then converting the television field data into non-interlace frame data based on the repeat flag such that the television field data is skipped for conversion if the repeat flag indicates that the repeat field data is to be output, wherein:

a vertical sync signal is output and, if the repeat flag indicates that the repeat field data is to be output, the vertical sync signal is masked, the television field date is captured for converting based on the vertical sync signal, a horizontal sync signal is output and, if the repeat flag indicates that the repeat field data is to be output, the horizontal sync signal is masked, and the television field date is captured for converting based on the horizontal sync signal.

6. A method for displaying an image, the method comprising:

decoding video contents to produce television field data wherein the video contents data includes interlace field data and a repeat flag indicating whether the television field data is to be output;

outputting the repeat flag, the television field data, and a vertical sync signal;

masking the vertical sync signal if the repeat flag indicates that the television field data is not output and then capturing the television field data for conversion based on the vertical sync signal;

synthesizing two television field data to produce a frame signal; and outputting a horizontal sync signal, and if the repeat flag indicates that the television field data is not output, masking the horizontal sync signal.

* * * * *

UNITED STATES PATENT AND TRADEMARK OFFICE

CERTIFICATE OF CORRECTION

PATENT NO. : 6,441,813 B1
DATED : August 27, 2002
INVENTOR(S) : Ishibashi

It is certified that error appears in the above-identified patent and that said Letters Patent is hereby corrected as shown below:

Column 16,
Line 63, change “date” to -- data --.

Column 17,
Line 1, change “date” to -- data --.

Signed and Sealed this

Eighteenth Day of March, 2003

JAMES E. ROGAN
*Director of the United States Patent and Trademark Office*